US006263523B1

(12) United States Patent
Moore

(10) Patent No.: US 6,263,523 B1
(45) Date of Patent: Jul. 24, 2001

(54) SHOWER ENCLOSURE SYSTEM

(76) Inventor: Sean A. Moore, 3826 Merrick, Houston, TX (US) 77025

( * ) Notice: Subject to any disclaimer, the term of this patent is extended or adjusted under 35 U.S.C. 154(b) by 0 days.

(21) Appl. No.: 09/452,775

(22) Filed: Dec. 2, 1999

Related U.S. Application Data

(62) Division of application No. 09/188,463, filed on Nov. 9, 1998, now abandoned.

(51) Int. Cl.[7] ..... A47K 3/38
(52) U.S. Cl. ..... 4/610; 248/262
(58) Field of Search ..... 4/608, 610; 211/105.1, 211/105.2; 248/262, 264

(56) References Cited

U.S. PATENT DOCUMENTS 839,959 * 1/1907 Richards ..... 248/262
912,789 * 2/1909 Berbecker ..... 248/262
2,650,714 * 9/1953 Brose et al. ..... 211/105.1
2,890,799 * 6/1959 Rosenbaum ..... 211/105.2
4,496,059 * 1/1985 Leiter ..... 211/105.1

* cited by examiner

*Primary Examiner*—Robert M. Fetsuga
(74) *Attorney, Agent, or Firm*—Felsman, Bradley, Vaden, Gunter & Dillon, L.L.P.

(57) ABSTRACT

A shower enclosure system includes an elongate arcuate rod having first and second spaced end portions, a pair of swivels, with one swivel at each of the end portions, and a pair of swivel-receiving wall mounts for mounting on opposing walls of a shower enclosure, with each of the swivels to receive one of the swivels. The system includes a shower curtain rod which is shaped so that the bathroom is protected by draping the shower curtain in such a way that splashed water does not escape from the bath tub. The shape of the curtain rod provides added space outside the perimeter of the tub footprint, for the comfort of the user within the shower enclosure. However, the added space within the shower enclosure does not compromise the integrity of the water capturing function of the shower curtain.

11 Claims, 9 Drawing Sheets

SHOWER ENCLOSURE SYSTEM

This application is a division of application No. 09/188,463, filed Nov. 9, 1998, abandoned.

FIELD OF THE INVENTION

The present relates generally to the field of shower enclosures and, more particularly, to a flexible and adjustable shower enclosure system that is adapted to conform to practically any footprint of a shower area of a manufactured or custom shower installation. The shower enclosure of this invention includes an adjustable bracket which pivots horizontally in either direction with a range of motion up to 140°, or even more, and a system of rod segments which may telescope or otherwise connect to conform to a given shower enclosure depending on the component rod segments selected.

BACKGROUND OF THE INVENTION

A present day bathtub arrangement commonly includes a shower nozzle mounted on the wall within an enclosure above the tub to provide the option of a shower for the resident using the bathroom facility. Water from the shower nozzle is intended to be confined to the enclosure by a sliding door, typically a translucent plastic or shatter proof glass, or more conveniently, a shower curtain. The shower curtain is ordinarily constructed and arranged to drape loosely from a set of eyelets or curtain rings which slide along a straight curtain rod. A set of such rings is normally mounted slidably on the shower curtain rod which is positioned normally at or above the height of the shower nozzle.

The shower curtain is draped in the bath tub below the straight curtain rod so that water is not splashed out of the bath tub. Because the bath tub is below the shower nozzle, the bath tub functions to collect water which drains from the bath tub during the shower. Since a curtain rod is typically a straight piece of pipe, and the inside surface of the tub into which the curtain is draped is usually at least partially curved, the shower curtain is often drawn away from its natural straight drape created by the straight rod to drape instead into or along the curving rim of the tub, thus this departure from its natural drape draws the curtain way from the wall of the shower enclosure. This phenomenon leaves a gap between the curtain and enclosure wall, and this gap provides a means for leakage of shower water from the shower enclosure.

Thus, there remains a need for a shower curtain that is configured to create a natural drape of the curtain that conforms to the curving portion of the tub, altering the conventional location and angle at which the curtain meets the wall to minimize the gap between the shower curtain and the shower wall and render harmless any water that should escape the curtain.

Further, a tub fixture today commonly comes in one of a number of standard sizes. This standard size tub is put in place, and then a wall structure is completed adjacent or around the tub, generally on two or three sides of the tub. As the wall structure is installed, it is customized to fit over the rim or outer edge of the tub, and may encroach more or less over the top surface of the tub. Thus, the longitudinal distance that the curtain rod must span varies, often varying over an inch or more. If a standard, straight curtain rod is then installed, it often requires some modification to the enclosure to fit properly. Also, the enclosure is almost never perfectly square, with perfectly parallel facing walls. Thus, a standard straight rod with inflexible mounting brackets will not fit perfectly flush and will therefore leave unsightly gaps around the fixtures, if the rod fits at all.

Also, typically the drape of the curtain in the center portion of the tub where a person is most likely to be showering is restricted to a uniform vertical drape that is created by the rigid horizontal plane of the straight rod. Thus, the amount of space available to the bather in the center of the enclosure is restricted directly by the end wall placement or mounting of the rod.

When shower water is running within the enclosure, the curtain is a barrier between the cooler air outside the shower enclosure and the warmer air within created by steam and running hot water. This difference in air temperature and pressure on opposing sides of the curtain creates a tendency for the curtain to drift inward into the showering area as the cooler outside air seeks to replace the rising warm air within the enclosure. This inward drifting tendency of the curtain often causes unwanted contact between the person showering and the curtain.

Thus, there remains a need for a curtain rod that is flexible and adaptable to a shower enclosure, without the need for modification of the enclosure itself to receive the rod. The rod and it's mounting hardware should present a finished appearance, even over a widely varying geometry of space into which the rod is to be installed. Further, the rod should provide additional shoulder and elbow room for a bather within the shower enclosure, which added space in the center portion of the tub is outside the horizontal plane that runs directly between the mounting brackets, without the need for any other additional elements to the shower enclosure.

SUMMARY OF THE INVENTION

The present invention addresses these and other shortcomings of the prior art by providing a shower curtain rod which is shaped so that the bathroom is protected by draping the shower curtain in such a way that splashed water does not escape from the bath tub. The shape of the curtain rod provides added space outside the perimeter of the tub footprint, for the comfort of the user within the shower enclosure. However, the added space within the shower enclosure does not compromise the integrity of the water capturing function of the shower curtain.

The present invention takes advantage of the recognition that almost all tubs have some curvature on the inside surface of the vertical wall of the tub. Even a tub with a substantially straight side wall includes a curved portion into the substantially straight back wall. The rod of this invention includes an arcuate segment, one or more straight segments, and a pivotable bracket for mounting the curtain rod to the wall of the enclosure. The segmentation of the rod makes it adaptable to a variety of the variations of tub installations. The pivotable wall bracket permits the curtain rod to be installed easily with a finished appearance in wall enclosure that are out of plumb, and brings the rod to the wall at a preferred angle to minimize out-leakage from the shower enclosure and adapt to the footprint of any particular tub or shower enclosure.

These and other features are described below, along with the accompanying drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIGS. 5*a* through 54*c* are top views of the segmented curtain rod of this invention, adapted to be installed in a two wall enclosure.

DETAILED DESCRIPTION OF PREFERRED EMBODIMENTS

Figure 1A:
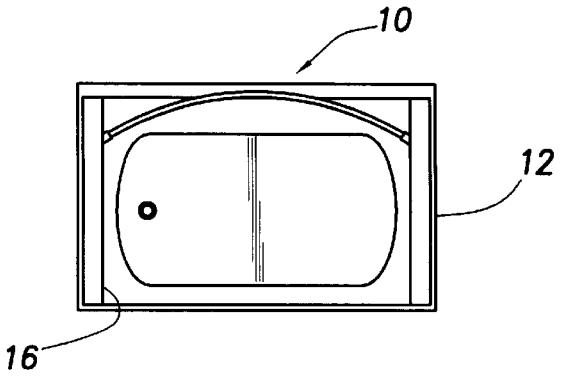
FIG. 1*a* and 1*b* are plan views of bathtubs in which the shower enclosure of this invention is advantageously applied.
Figure 1B:
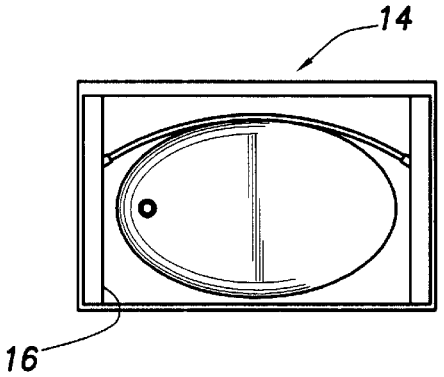

FIG. 1*a* and 1*b* depict an enclosure system 10 of this invention installed above a substantially rectangular tub 12 or an oval-shaped tub 14. In both cases, the enclosure system 10 of this invention drapes a curtain (not shown) at a tangent along a curvature of the tub 12 of 14 close to a wall 16 of the enclosure. It is this feature of this invention which minimizes the gap between the curtain and the wall, thereby retaining shower water within the enclosure system and the location and angle of the mounting bracket receiving the tangent causes any such water that may escape the curtain to run down the wall back into the tub and not onto the bathroom floor. An arcuate curtain rod is depicted in copending U.S. Patent application, Ser. No. 08/739,888, filed Oct. 31, 1996, and incorporated herein by reference. The present invention enhances this feature by including a rotatable mount to mount the rod to the wall 16, which is shown below.

FIG. 1*a* and 1*b* depict one of the features of this invention, in that the arcuate curtain rod provides additional space outward of a line between the mounting brackets that would not be provided by a straight rod. In other words, the shower enclosure system of this invention provides additional space for a bather within the enclosure, and that space may extend beyond the footprint of the tub enclosure. As used herein, the term "footprint" refers to space that would otherwise be provided by a tub with a straight curtain rod, and the present invention therefor provides space beyond that footprint, as shown in FIG. 1*a*, without the need for any additional hardware, other than the rod and its mounting hardware. And, this additional space does not compromise the integrity of the water retaining capabilities of the curtain.

Figure 2A:
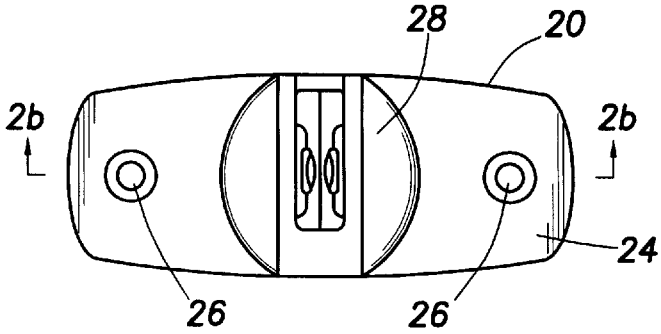
FIGS. 2*a* and 2*b* are plan and side section views of a wall-mounted bracket of this invention, respectively.
Figure 2B:
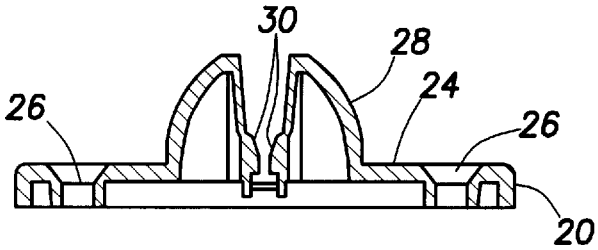
Figure 2C:
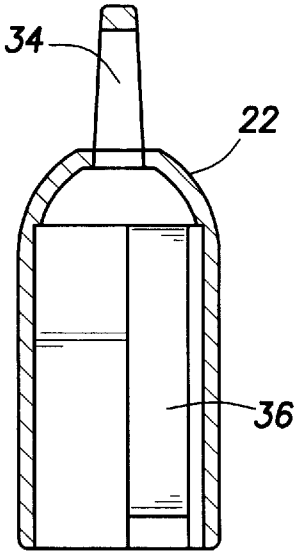
FIGS. 2*c* and 2*d* are side and top section views of the swivel of this invention, respectively.
Figure 2D:
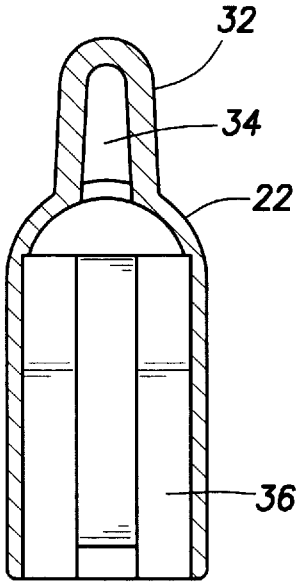
Figure 2E:
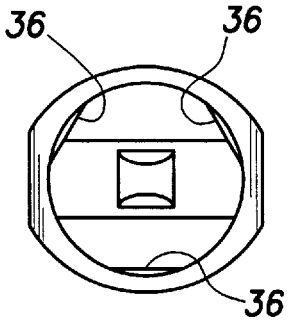
FIG. 2*e* is an end view of the swivel of FIGS. 2*c* and 2*d*.

FIGS. 2*a* and 2*b* depict a wall mount 20 for such a flexible system. The wall mount 20 is adapted to be attached to the wall 16 and to receive a swivel 22, shown in FIGS. 2*c* and 2*d*, so that the enclosure system may be mounted between any two walls, whether or not the wall are parallel. The wall mount 20 includes a face plate 24 which provides a low profile to wall 16. The face plate is provided with screw holes 26 to securely mount the wall mount.

Molded integral with the face plate is a flexible clamp 28 which includes a pair of opposing flexing teeth 30. The teeth are biased apart when a swivel 22 is inserted into the clamp 28. This securely retains the swivel 22 within the clamp, while providing the swivel with freedom to rotate about the teeth 30 in order to align properly with the wall 16.

The swivel 22 includes a protruding loop 32 with a hole 34 through the loop to receive the teeth 30. Alternatively, the loop may be closed off with a thin plate of material, and thus provide a recessed area to the receive the teeth. The swivel 22 is substantially cylindrical in overall configuration, with an opening at one end to the receive a curtain rod and enclosed at the other end to define the loop 32.

The wall mount 20 and the swivel 22 in the embodiment depicted in FIGS. 2*a* through 2*e* are preferably made of an easily molded plastic. The swivel therefore in this embodiment includes a plurality of flats 36 which serve to firmly grasp a curtain rod inserted into the swivel.

Figure 3A:
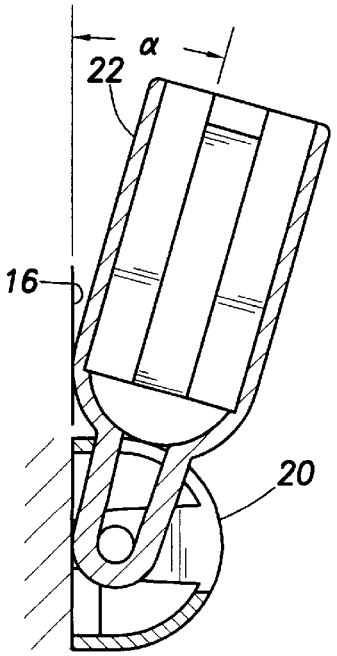
FIGS. 3*a* and 3*b* and top, section view of the swivel of this invention.
Figure 3B:
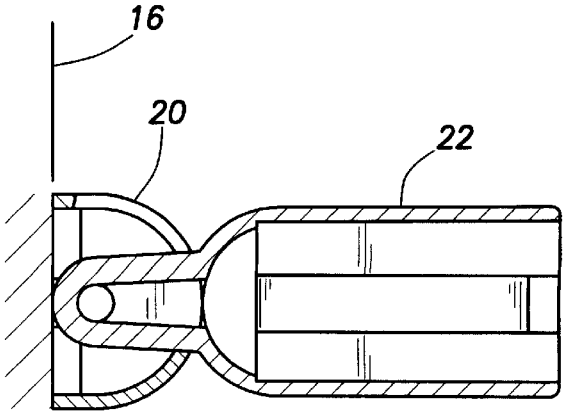

FIGS. 3*a* and 3*b* depict the swivel 22 and wall mount 20 combination mounted to a wall 16. FIGS. 3*a* and 3*b* clarify one of the advantages of this invention, that the same wall mount and swivel combination may be used, regardless of whether the enclosure system of this invention is being installed in a two- or three-wall enclosure. This feature of this invention is shown in greater detail with regard to FIGS. 4*a* through 4*c* and 5*a* through 5*c*. Note that the angle of the limit of travel, shown as an angle $\alpha$ in FIG. 3*a*, is limited only by the shape of the swivel 22.

Figure 4A:
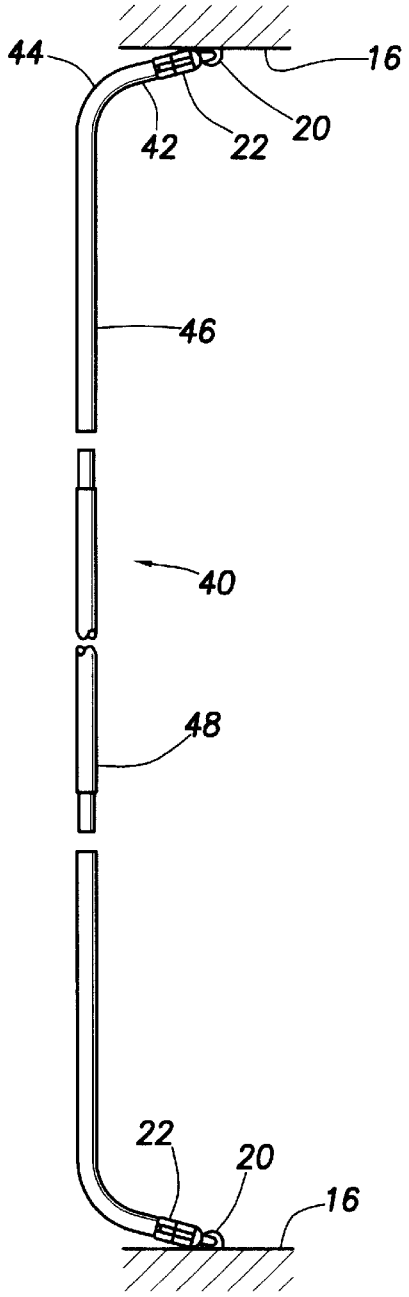
FIGS. 4*a* through 4*c* are top views of the segmented curtain rod of this invention, adapted to be installed in a three wall enclosure.
Figure 4B:
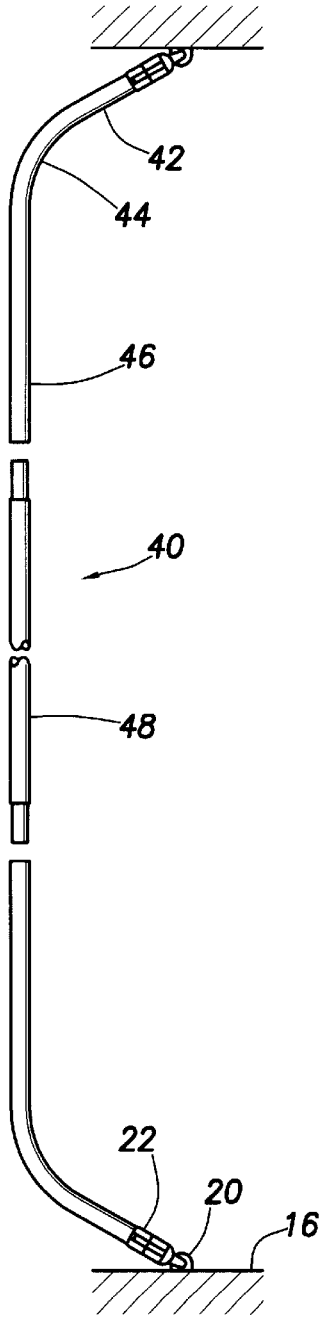
Figure 4C:
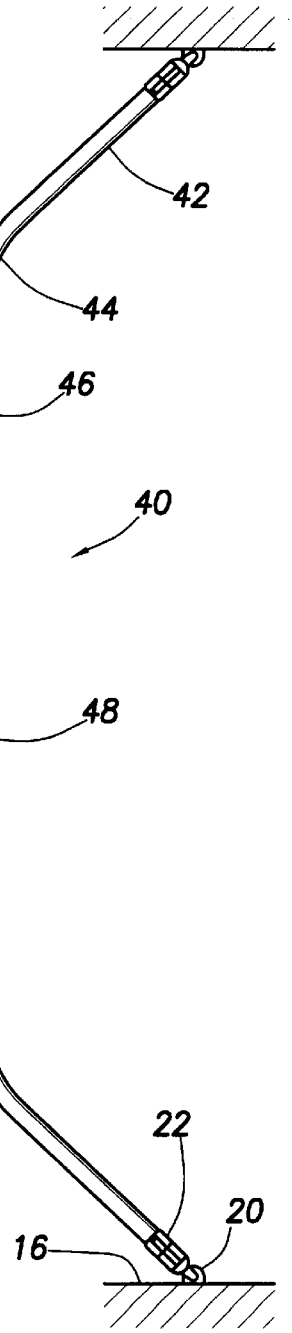

FIGS. 4*a* through 4*c* depict the enclosure system of this invention as installed between opposing walls 16. The enclosure system comprises a pair of wall mounts 20, a pair a swivels 22, and a curtain rod 40 coupled to and between the swivels 22. The rod includes a straight section 42, which may also be referred to an a tangent section 42, a curved section 44, and a straight connecting section 46. In a preferred embodiment, the rod 40 also includes a straight, detachable segment 48. The rod portion including the tangent section 42, the curved section 44, and the straight connection section 46 is preferably hollow, to save on weight and material, and therefore cost, and for ease of manufacture. In either case, the connecting section 46 and the ends of the segment 48 provide male and female connections to couple the section 46 and segment 48 together. If the section 46 is hollow, thereby providing the female portion of the coupling, then the section 46 maybe be cut off easily to adapt the enclosure to any distance between opposing walls 16 equal to or less than the full, uncut length of the system.

Note also that the advantages of the enclosure system of this invention described with regard to FIG. 1*a* and 1*b* are maintained with the configuration of FIGS. 4*a* through 4*b*. The rod drapes the curtain rod away from a person within the enclosure, providing added elbow room, while the rod conforms to the curvature at the inside wall of the tub below, to retain the integrity of the water capturing capability of the curtain.

Figure 5A:
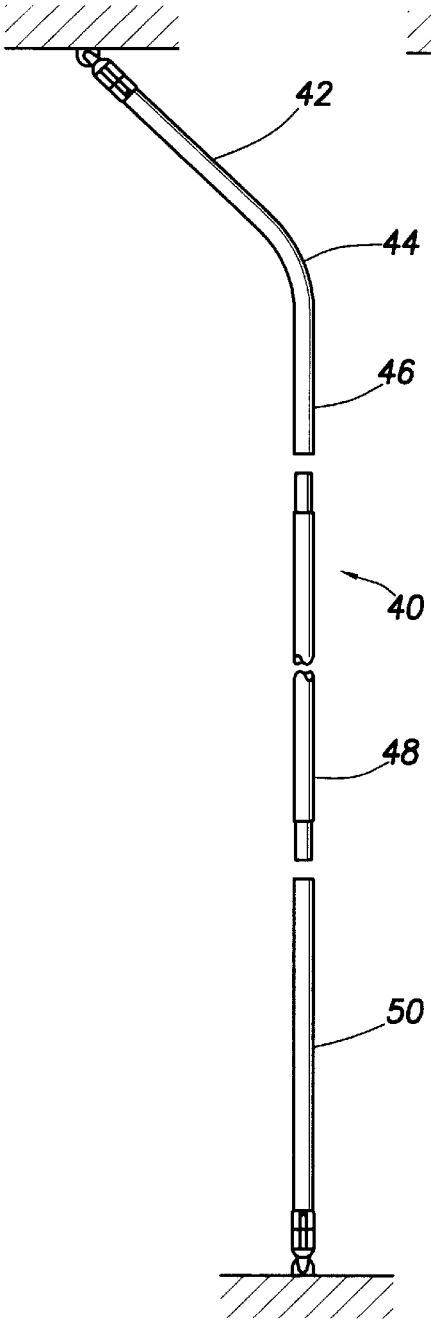
Figure 5B:
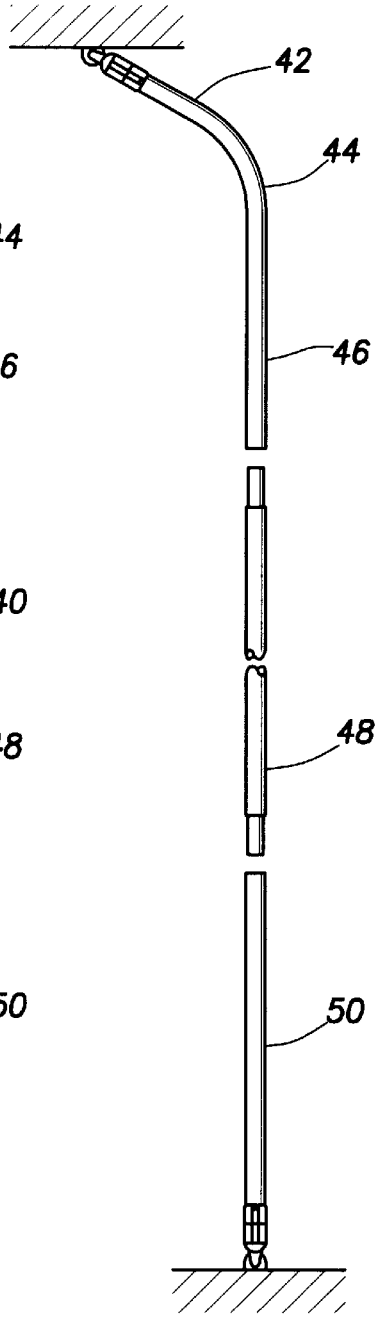
Figure 5C:
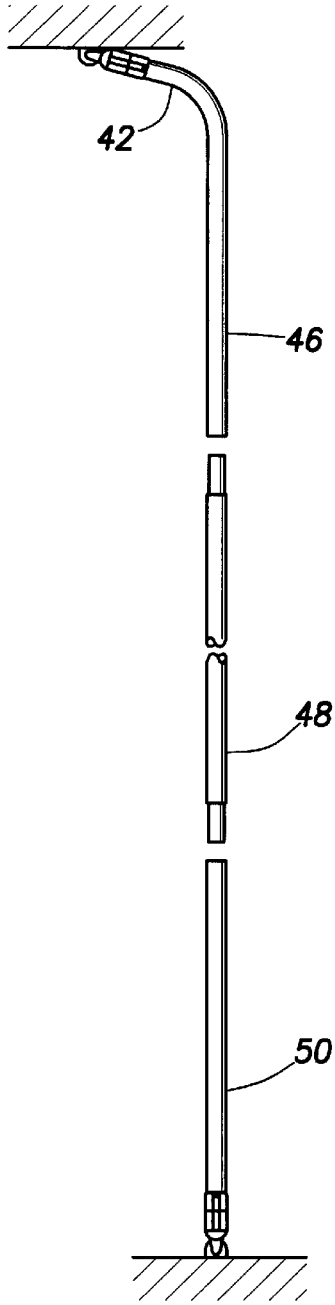

FIGS. 5*a* through 5*c* depict an enclosure system of the invention, but instead of a mirror image curved section including sections 42, 44, and 46 at one end of the rod 40, the rod in this case includes one straight section 50 at that end. This configuration may also be adapted to conform to a tub installed within a two-wall enclosure.

The wall mount 20 and swivel 22 described to this point is simple, light, and easy to manufacture. However, certain applications require more robust components or such components may simply be desired. The mount/swivel combinations of FIGS. 6*a*–6*h* and 7*a*–7*h* respond to that desire.

Figure 6A:
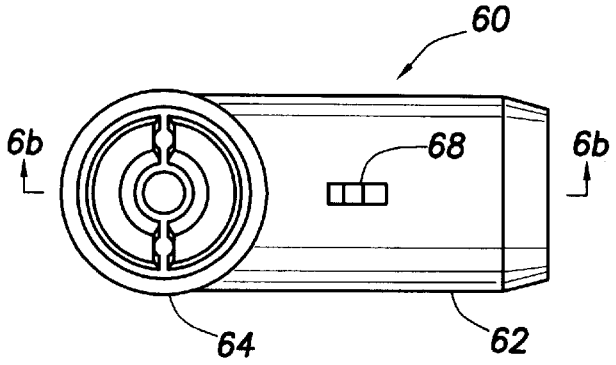
FIG. 6*a* depicts a top view of another embodiment of swivel of this invention.
Figure 6B:
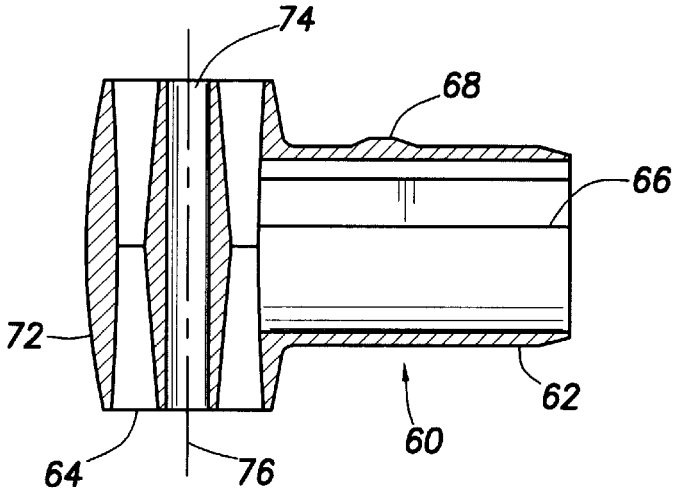
FIG. 6*b* depicts a side section view of the swivel of FIG. 6*a*.
Figure 6G:
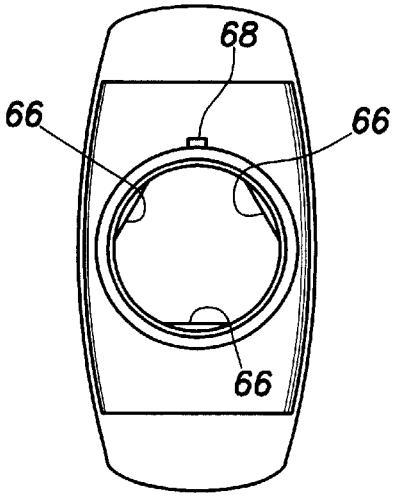
FIG. 6*g* depicts and end view of the swivel of FIGS. 6*a* through 6*f*.
Figure 6H:
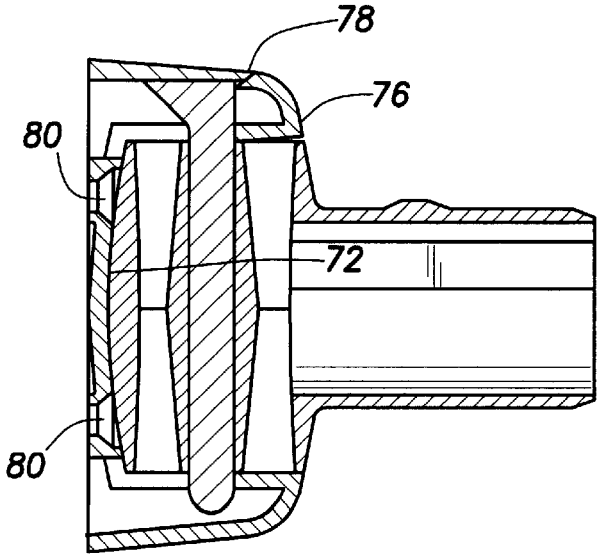
FIG. 6*h* depicts a side section view of the swivel and bracket combination of FIGS. 6*c* through 6*f*.
Figure 6C:
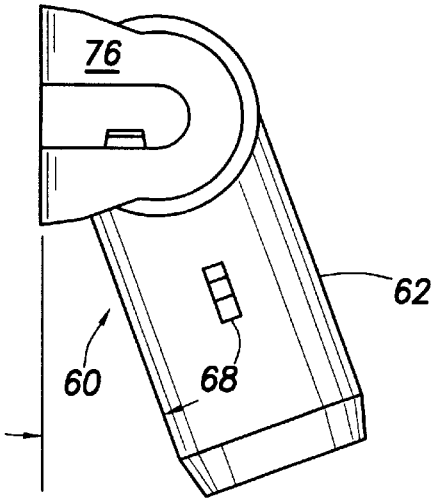
FIGS. 6*c* and 6*d* depict top views of the swivel of FIG. 6*a* in combination with a wall bracket.
Figure 6D:
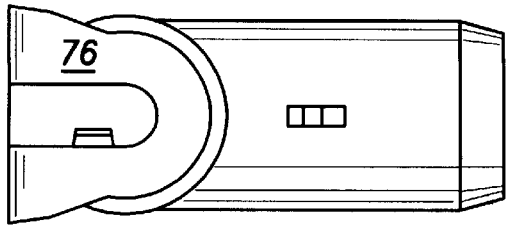
Figure 6E:
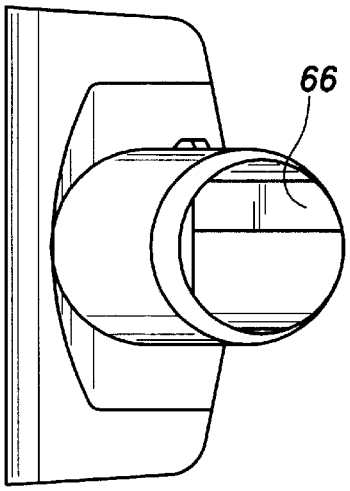
FIGS. 6*e* and 6*f* depict side views of the swivel and bracket combination of FIGS. 6*c* and 6*d*.
Figure 6F:
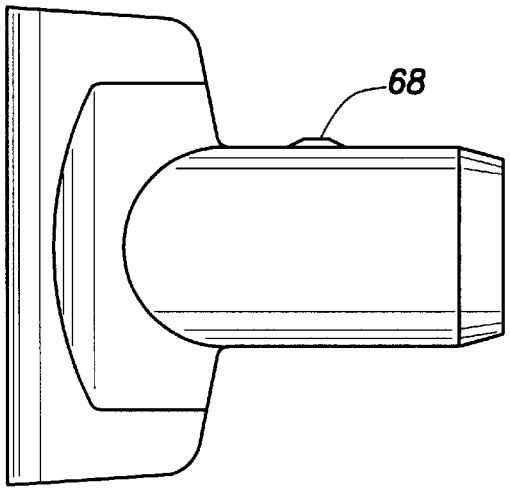
Figure 7A:
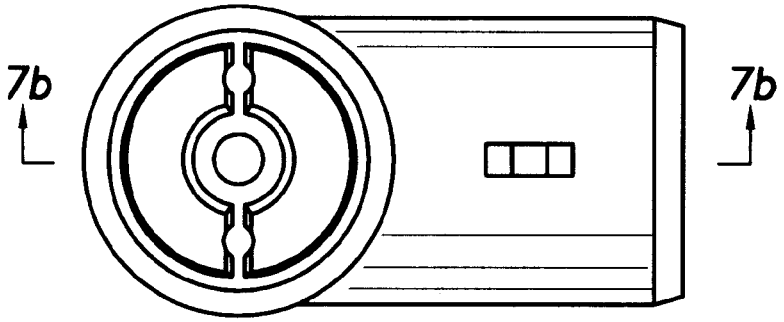
FIG. 7*a* depicts a top view of another embodiment of swivel of this invention.
Figure 7B:
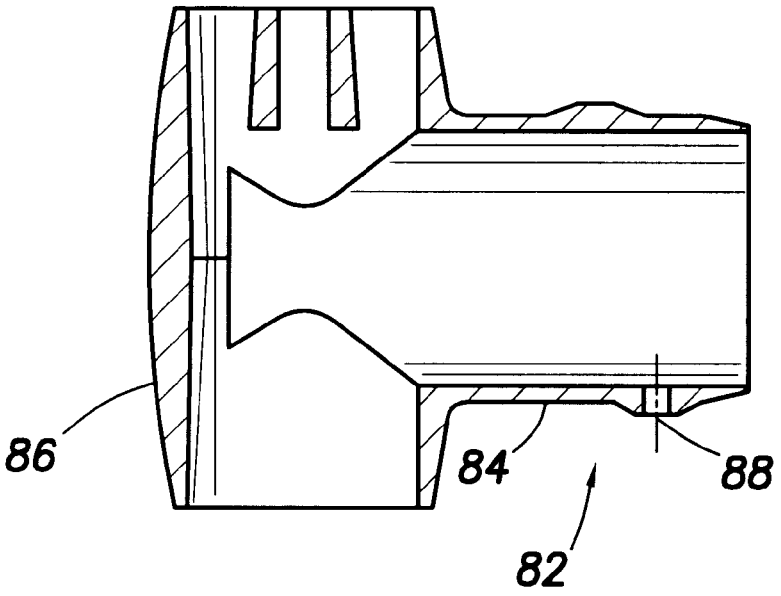
FIG. 7*b* depicts a side section view of the swivel of FIG. 7*a*.
Figure 7C:
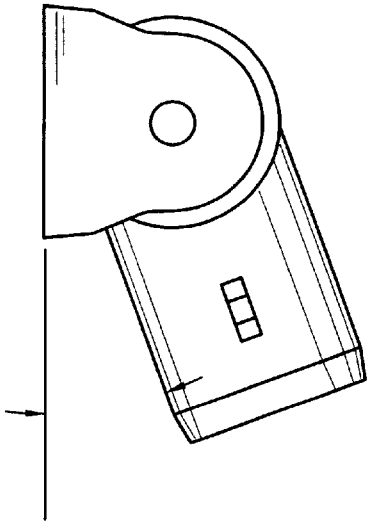
FIGS. 7*c* and 7*d* depict top views of the swivel of FIG. 7*a* in combination with a wall bracket.
Figure 7D:
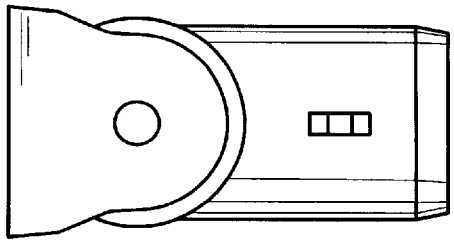
Figure 7E:
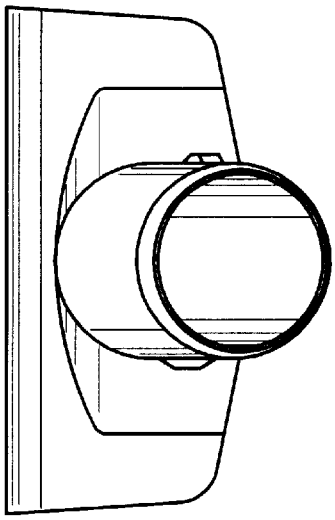
FIGS. 7*e* and 7*f* depict side views of the swivel and bracket combination of FIGS. 7*c* and 7*d*.
Figure 7F:
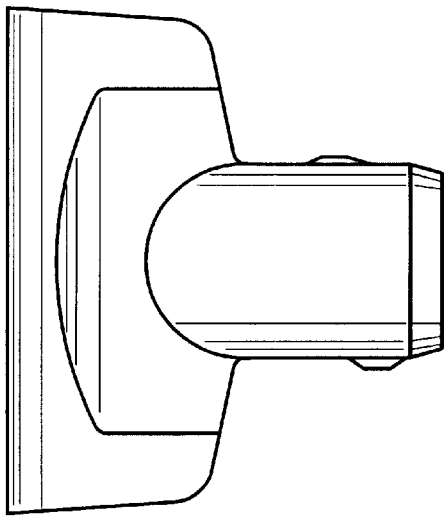
Figure 7G:
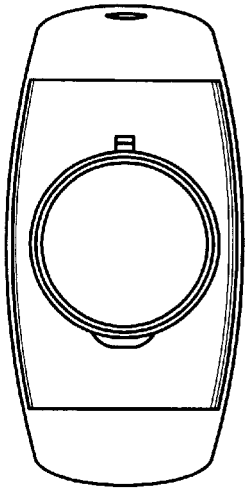
FIG. 7*g* depicts and end view of the swivel of FIGS. 7*a* through 7*f*.
Figure 7H:
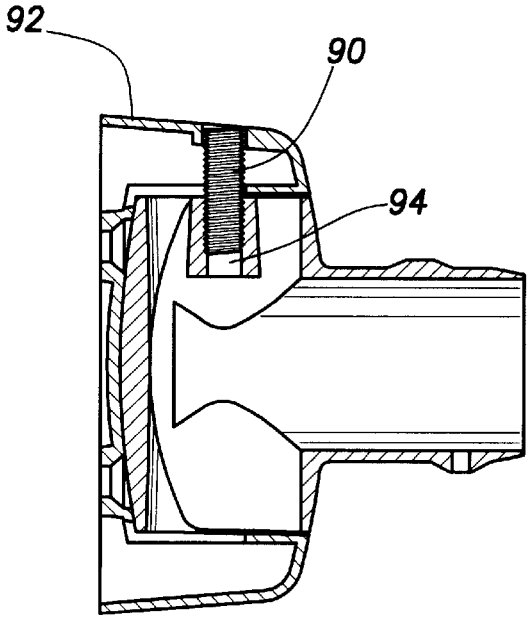
FIG. 7*h* depicts a side section view of the swivel and bracket combination of FIGS. 7*c* through 7*f*.

The mount/swivel combination of FIGS. 6*a*–6*h* is preferably made of plastic. The primary distinction of the swivel shown in FIGS. 6*a* through 6*h*, over that previously described, is the more robust coupling with the wall mount. FIG. 6*a* depicts a top view of such a swivel 60. This swivel 60 includes a substantially cylindrical rod-receiving extension 62 and a substantially cylindrical bearing 64. As previously described, the rod-receiving extension 62 includes a plurality of flats 66 to tightly grasp a curtain rod inserted into the extension. Integrally formed on an upper outside surface of the extension 62 is a curtain rod ring keeper 68, to temporarily hold the ring at each end of the curtain in place while one takes a shower.

The bearing 64 is integrally formed with the extension 62 and defines an axis 70 perpendicular to the extension. Overall, the bearing defines a truncated oblate spheroid, and therefore forms a spheroidal bearing surface 72 which conforms to complementary surface on the wall bracket, described below with regard to FIG. 6*h*. The bearing also includes an axial channel 74 therethrough, to receive an axis pin, also shown in FIG. 6*h*.

FIG. 6*c* through 6*g* depict the wall mount 76 and swivel 60 in combination in various positions. This embodiment provides more robustness to withstand the various torsion and other stresses during normal usage of the enclosure system. This system also presents a more streamlined appearance, in that the swivel and wall mount fit flush together. Note also that mounting screw holes 80 are also hidden underneath the swivel, presenting an even more streamlined appearance. In this embodiment, the swivel and wall mount are joined together with an axis pin 78, which is also hidden within the wall mount.

FIGS. 7*a* through 7*h* depict yet another preferred embodiment. This embodiment also includes a swivel 82 comprising an extension 84 and a bearing 86. This embodiment is preferably made of zinc or other metallic or similar material. Since this embodiment is made of metal, the flats 66 of the previous embodiment would be ineffective in grasping a rod, so a set screw opening 88 is provided. The set screw opening 88 may also be provided on the top of the extension. The use of metal also eliminates the need for an axial channel 74 penetrating all the way through the bearing. Consequently, an axle screw 90 penetrates the wall mount 92 and into an opening 94 which only penetrates a short distance into the bearing.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A shower enclosure system comprising:

a. an elongate arcuate rod having first and second spaced end portions, wherein the rod defines a curved section proximate the center of the length of the rod and a straight section proximate each end of the rod;

b. a pair of swivels, with one swivel at each of the end portions, wherein each of the swivels comprises i a hollow, axially oriented cylindrical member adapted to slidingly and adjustably receive an end of a rod; and ii. a bearing oriented at an axis perpendicular to the axis of the cylindrical member, wherein the bearing defines a truncated oblate spheroid; and c. a pair of swivel-receiving wall mounts for mounting on opposing walls of a shower enclosure, with each of the swivels to receive one of the swivels.

2. The system of claim 1, wherein the rod is segmented into a plurality of detachable segments.

3. The system of claim 2, wherein one of the segments comprises a straight segment of pipe, and wherein at least one of the segments comprises a bent segment of pipe.

4. The system of claim 1, wherein each of the pair of swivels may be horizontally pivoted over an arc.

5. The system of claim 1, further comprising an axle channel along the axis of the bearing and running the length of the bearing.

6. The system of claim 1, further comprising an axle channel along the axis of the bearing and running a distance through the bearing that is less than the length of the bearing.

7. The system of claim 5, further comprising an axle pin through the channel and secured to the wall mount.

8. The system of claim 1, further comprising a plurality of flats on the interior surface of the cylindrical member, wherein the flats are capable of grasping a rod inserted into the cylindrical member.

9. The system of claim 1, further comprising a set screw access through the cylindrical member, and further comprising a set screw.

10. A method of forming a shower enclosure system, comprising the steps of:

a. mounting a pair of opposing wall mounts to opposing walls, b. coupling a swivel to each of the wall mounts, each swivel capable of pivoting relative to the wall mount to which it is coupled, each swivel further adapted to receive an end of an arcuate curtain rod, wherein each of the swivels comprises i a hollow, axially oriented cylindrical member adapted to slidingly and adjustably receive an end of a rod: and ii. a bearing oriented at an axis perpendicular to the axis of the cylindrical member, wherein the bearing defines a truncated oblate spheroid; and c. inserting an end of an end of the curtain rod into a respective one of the swivels.

11. The system of claim 1, further comprising a curtain rod ring keeper on an exterior surface of the axially oriented cylindrical member.

* * * * *

UNITED STATES PATENT AND TRADEMARK OFFICE

CERTIFICATE OF CORRECTION

PATENT NO. : 6,263,523 B1
DATED : July 24, 2001
INVENTOR(S) : Sean A. Moore

It is certified that error appears in the above-identified patent and that said Letters Patent is hereby corrected as shown below:

Title page,
ABSTRACT, correct the first sentence as follows:
-- A shower enclosure system includes an elongate arcuate rod having first and second spaced end portions, a pair of swivels, with one swivel at each of the end portions, and a pair of swivel-receiving wall mounts for mounting on opposing walls of a shower enclosure, with each of the [swivels] swivel-receiving wall mounts to receive one of swivels. --

Claim 1,
Correct element (c) to read as follows:

-- c. a pair of swivel-receiving wall mount for mounting on opposing walls of a shower enclosure, with each of the [swivels] swivel-receiving wall mounts to receive one of the swivels. --

Signed and Sealed this

Ninth Day of April, 2002

*Attest:*

*Attesting Officer*

JAMES E. ROGAN
*Director of the United States Patent and Trademark Office*